United States Patent [19]

Pinkerton et al.

[11] Patent Number: 4,718,856

[45] Date of Patent: Jan. 12, 1988

[54] SAFETY COVERS FOR ELECTRICAL OUTLETS (II)

[76] Inventors: Michael B. Pinkerton, 2015 144th SE., Bellevue, Wash. 98007; David Moskowitz, 1803 127th SE., Bellevue, Wash. 98005

[21] Appl. No.: 897,083

[22] Filed: Aug. 18, 1986

Related U.S. Application Data

[63] Continuation-in-part of Ser. No. 815,528, Jan. 2, 1986, Pat. No. 4,691,974.

[51] Int. Cl.[4] ..... H01K 13/44

[52] U.S. Cl. ..... 439/147; 439/136

[58] Field of Search ..... 339/36, 38, 39, 25

[56] References Cited

U.S. PATENT DOCUMENTS

| | | | |
|---|---|---|---|
| 3,363,216 | 1/1968 | Benedetto | 339/39 |
| 3,601,757 | 8/1971 | Gober | 339/39 |
| 3,656,083 | 4/1972 | Brook | 339/39 |
| 3,811,104 | 5/1974 | Caldwell | 339/39 |
| 3,955,870 | 5/1976 | Wasserman | 339/39 |
| 4,076,360 | 2/1978 | Singh | 339/36 |
| 4,531,800 | 7/1985 | Avener | 339/39 |

*Primary Examiner*—Gil Weidenfeld
*Assistant Examiner*—Paula A. Austin
*Attorney, Agent, or Firm*—Hughes & Cassidy

[57] ABSTRACT

A protective cover for restricting access to the female sockets or connectors of an electrical outlet, thereby protecting infants and small children and others of limited understanding against electrical shock. The cover includes a base plate bearing an externally threaded boss which replaces the conventional outlet cover; a safety cap of the push-and-twist type threaded on the boss; protective members which are clamped by the safety cap against the boss overlying the socket being protected to deny access to the socket, both when the socket is in use and when it is not in service; and a platelike shield which normally overlies, and denies access to, a second female socket of the typical double socket wall outlet. This shield can be swung aside after backing off the safety cap to furnish unprotected, but controlled, and typically temporary, access to that second female socket.

4 Claims, 3 Drawing Figures

SAFETY COVERS FOR ELECTRICAL OUTLETS (II)

RELATED APPLICATION

This application is a continuation-in-part of application Ser. No. 815,528 filed Jan. 2, 1986 now U.S. Pat. No. 4,691,974.

BACKGROUND OF THE INVENTION

The present invention relates to novel, improved covers which keep children and others unable to appreciate the dangers from gaining access to the exposed female sockets of an electrical outlet or to a male plug mated with such a socket.

Typically, the novel protective covers disclosed herein will be employed to control access to the sockets of a wall outlet; and the principles of our invention will be developed primarily by relation to that application. It is to be understood that this is being done for the sake of convenience and clarity, however, and that this approach is not intended to limit the scope of our invention as defined in the appended claims.

BACKGROUND OF THE INVENTION

An astonishing number of children are injured, maimed, and killed each year either by direct contact with a live electrical socket or by inserting a paper clip, knife blade, or other artifact into that socket.

A number of devices designed to control access to such sockets have heretofore been proposed. Without exception, they are relatively ineffective or too complex and expensive to be practical.

One heretofore proposed solution to the problem of controlling access to electrical outlets is described in U.S. Pat. No. 4,531,800 issued July 30, 1985, to Avener for PROTECTOR DEVICE FOR ELECTRICAL OUTLETS. The Avener device is complex, employing as it does split caps with locking tabs and collars of a relatively complicated configuration. Furthermore, the Avener device furnishes only a limited degree of protection unless a line cord is routed through it because there is an opening in the end of the Avener split cap through which a hair pin, paper clip, etc., could easily be inserted.

U.S. Pat. Nos. 3,363,216 issued Jan. 9, 1968, to Benedetto for SAFETY ATTACHMENT FOR ELECTRICAL OUTLET FIXTURES; 3,601,757 issued Aug. 24, 1971, to Gober for MALE PLUG RETAINER; and 4,076,360 issued Feb. 28, 1978, to Singh for SAFETY DEVICE FOR ELECTRICAL CONNECTOR DEVICE disclose yet another solution to the problem. These patentees employ internally threaded caps to control the access to electrical outlets. Their devices have the decided disadvantage that even a small child could readily unscrew the threaded caps the patentees employ. Consequently, the devices in question have only limited effectiveness. Furthermore, like that disclosed in Avener, the safety caps and associated components employed by Benedetto and Gober have openings through which a conductive artifact such as one of those identified above could easily be poked, also making these devices too ineffective to be practical.

Another protective device, disclosed in U.S. Pat. No. 3,955,870 issued May 11, 1976, to Wasserman for UTILITY OUTLET guard, is relatively complex and must be employed on a one-to-one basis with the sockets to be protected. Like others of those discussed above, Wasserman's device also has the decided disadvantage that, when a line cord is not routed through it, there is an opening through which foreign objects could be poked.

Another access controlling device of which applicants are aware is disclosed in U.S. Pat. No. 3,656,083 issued Apr. 11, 1972, to Brook for ELECTRICAL SAFETY DEVICE. The Brook devices have threaded, snap-in, and bayonet connections, all of which could be easily defeated by a curious child. And, again, there appear to be openings in all the caps disclosed by Brook through which foreign objects could readily be inserted.

Finally, our copending application Ser. No. 815,528 discloses novel, improved devices for electrical outlets which are free of those above-discussed disadvantages of the prior art devices known to us in that they are effective and, at the same time, sufficiently simple to be economically attractive.

In general, these novel protective devices have a cover which replaces the conventional outlet cover and can be attached to the box housing an electrical outlet by the same type of screw as is employed to attach a conventional cover. The protective cover disclosed in our copending application includes a plate resembling the conventional one and, integrated therewith, externally threaded bosses. These bosses surround openings fashioned in the plate and aligned with the sockets of the outlet when the cover is attached. Threadable onto these bosses are caps through which openings aligned with those in the cover's plate are formed.

The cooperating threads on the caps and bosses are so configured that the cap must be pressed toward the cover plate and simultaneously rotated to engage these threads. This scheme has been employed for a considerable time in closures for containers designed to contain medicines and other toxic substances, and it has been found to be essentially childproof.

Representative safety closures of the character just described are disclosed in U.S. Pat. No. 3,828,957 issued Aug. 13, 1984, to Marchant for CONTAINER WITH SAFETY CLOSURE; U.S. Pat. No. 4,032,028 issued June 28, 1977, to Reiss et al. for SAFETY CAP; and U.S. Pat. No. 4,353,475 issued Oct. 12, 1982, to Kachur et al. for SAFETY CLOSURE DEVICE.

When the socket of an outlet equipped with our previously disclosed invention is not in use, a (typically) disk-like barrier component is installed in the cap. The latter is then threaded onto that boss of the cover overlying the socket to be protected, clamping the barrier component against the boss. This completely isolates the socket from fingers, tongues, and other anatomical members, and from tableware, hairpins, and other foreign objects.

To similarly preclude access to a female socket being used, our previously disclosed protective covers are supplied with dome-shaped, flanged shields which are formed of a resilient material and split from end-to-end, allowing the edges of the shield to be pried apart and thereby providing a gap through which a line cord can be inserted after that cord has been routed through the safety cap. The prongs of the male plug attached to the line cord are then inserted into the female socket and the cap tightened onto the boss of the cover associated with that socket. This presses the rim of the safety cap against the flange of the dome-shaped shield, trapping the shield against the boss and thereby totally precluding access to the socket being used.

While the protective devices disclosed in parent application Ser. No. 815,528 are far superior to any theretofore disclosed and known to us, we have now found that there are features not possessed by those devices which it would be desirable for a protective cover to have. One such feature is the ability of the dome-shaped shield to accept plugs which are extraordinarily large or plugs with which an attachment is associated; for example, a clip such as is used to secure the free, plug-bearing end of a line cord in place when storing an appliance to which the line cord is attached or a two-prong to three-prong adapter.

Another feature that the protective covers disclosed in our copending application Ser. No. 815,528 necessarily lack is the capability which would allow temporary, controlled access to the second female socket of a typical wall outlet having one socket mated with an oversize plug while denying access to the first of those sockets via a protective cover in the manner described in our copending application.

SUMMARY OF THE INVENTION

We have now invented, and there are disclosed herein, certain novel protective devices for electrical outlets which have both of these important capabilities. Like the protective devices with which our copending application is concerned, those disclosed herein include a base plate which replaces a conventional outlet cover. However, the base plate has thereon only one integral boss onto which a safety cap can be threaded to preclude access to a female socket accessible through the boss by clamping either a barrier device to the boss when the socket is not in use or by clamping a plug surrounding shield to the boss when the socket is being used.

The plug embracing shields of the novel protective covers disclosed herein and the safety caps associated with those shields are typically designed to accommodate oversize plugs or plugs with which a clip or other attachment is proximately associated. The only limitation on the size of the plug, etc. that can be accommodated is the requirement that there be a central opening in the base plate of the protective cover through which a screw can be inserted to secure the protective cover to the wall outlet. This requires that the boss on which the safety cap is threaded be limited to a diameter which permits such access.

The above discussed requirement for shielding larger components typically means that only one line cord plug can be accommodated by the protective cover. However, the protective covers we have disclosed herein also have a platelike shield which overlies and denies access to the second female socket for the outlet; i.e., the outlet which does not receive the male line cord plug. And the threaded safety cap of the protective device can be backed off and the plate swung aside by rotating it about the boss, which extends through a matching opening in the just-described plate, to furnish access to the second of the female sockets. This affords unprotected but controlled, typically temporary access to the second of the sockets so that this second socket can also be used when convenience or necessity dictates. Once the need for access to the second female socket ends, the threaded cap of the protective device can again be swung back into place over the protected female socket and the safety cap retightened to deny all access to the unused female socket.

Aside from those attributes described above, the novel protective covers disclosed herein also have those possessed by the protective covers disclosed in parent application Ser. No. 815,528. These include simplicity and inexpensiveness.

OBJECTS OF THE INVENTION

From the foregoing, it will be apparent to the reader that one important and primary object of our invention resides in the provision of novel, improved protective covers for controlling the access to electrical outlets.

Another also important and primary object of the invention is the provision of protective covers for electrical outlets which are more effective in preventing access to the sockets being protected than those heretofore available protective devices of which we are aware.

A third object of our invention resides in the provision of protective covers for electrical outlets which are capable of accommodating oversize male line cord plugs and/or plugs which are bulky because clips or other attachments are associated with the plugs.

A related object of the present invention is the provision of protective covers for electrical outlets which are so constructed as to afford controlled, albeit unprotected, access to the second of the female sockets of a dual socket electrical outlet; i.e. to the female socket which is not intended to be mated to the oversized or attachment associated plug.

Still another object of our invention resides in the provision of protective covers for electrical outlets which are simple and can therefore be furnished at a sufficiently low cost to make them economically attractive.

Other important objects and features and additional advantages of our invention will be apparent to the reader from the foregoing and the appended claims and as the ensuing detailed description and discussion proceeds in conjunction with the accompanying drawing.

DETAILED DESCRIPTION OF THE INVENTION

Figure 1:
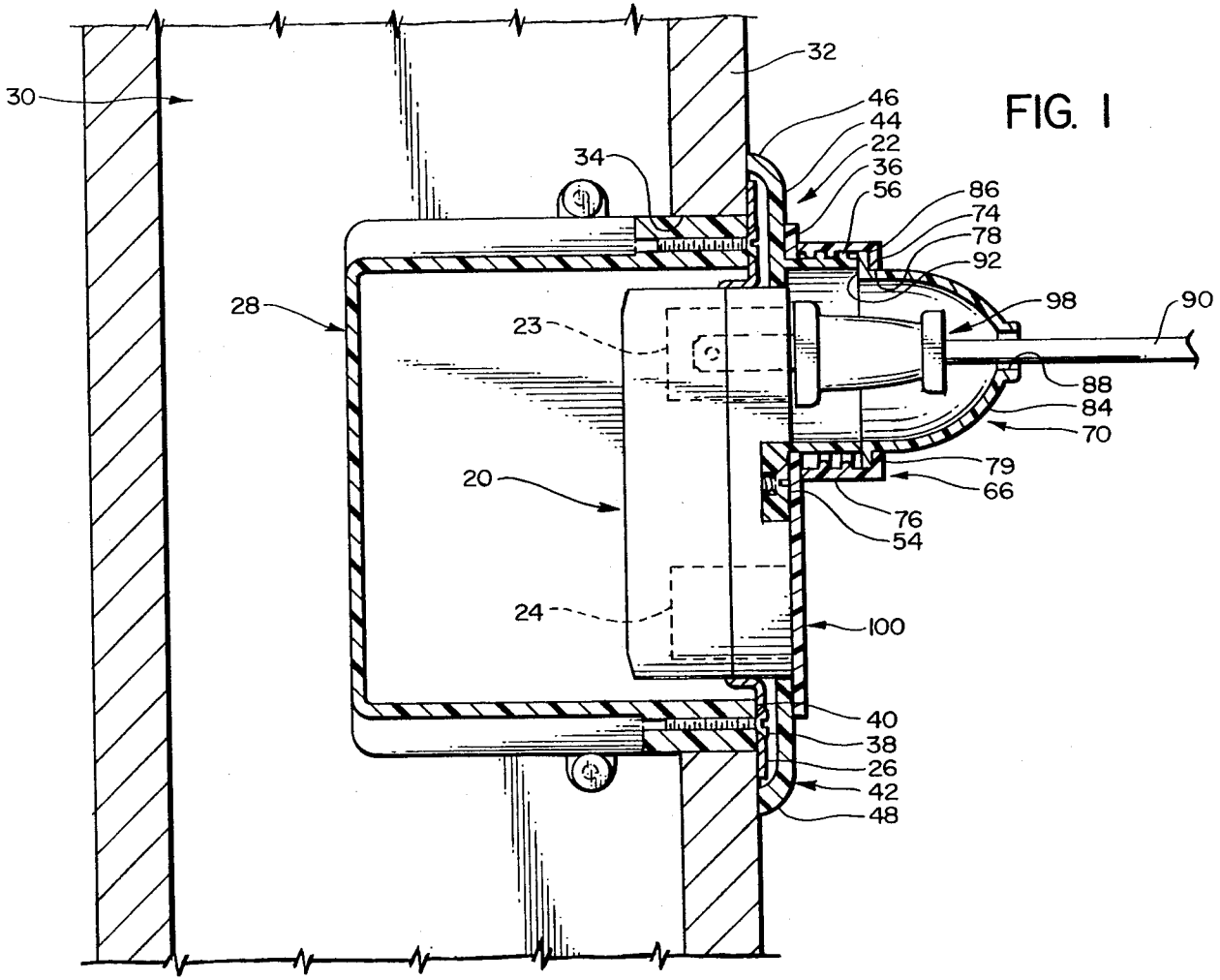
FIG. 1 is a section through an electrical wall outlet to which access has been restricted by attaching to the box in which the outlet is housed a protective cover embodying the principles of the present invention and designed to accommodate a single outsized male plug and to afford controlled access to the second, unoccupied female socket of a dual socket electrical outlet.
Figure 2:
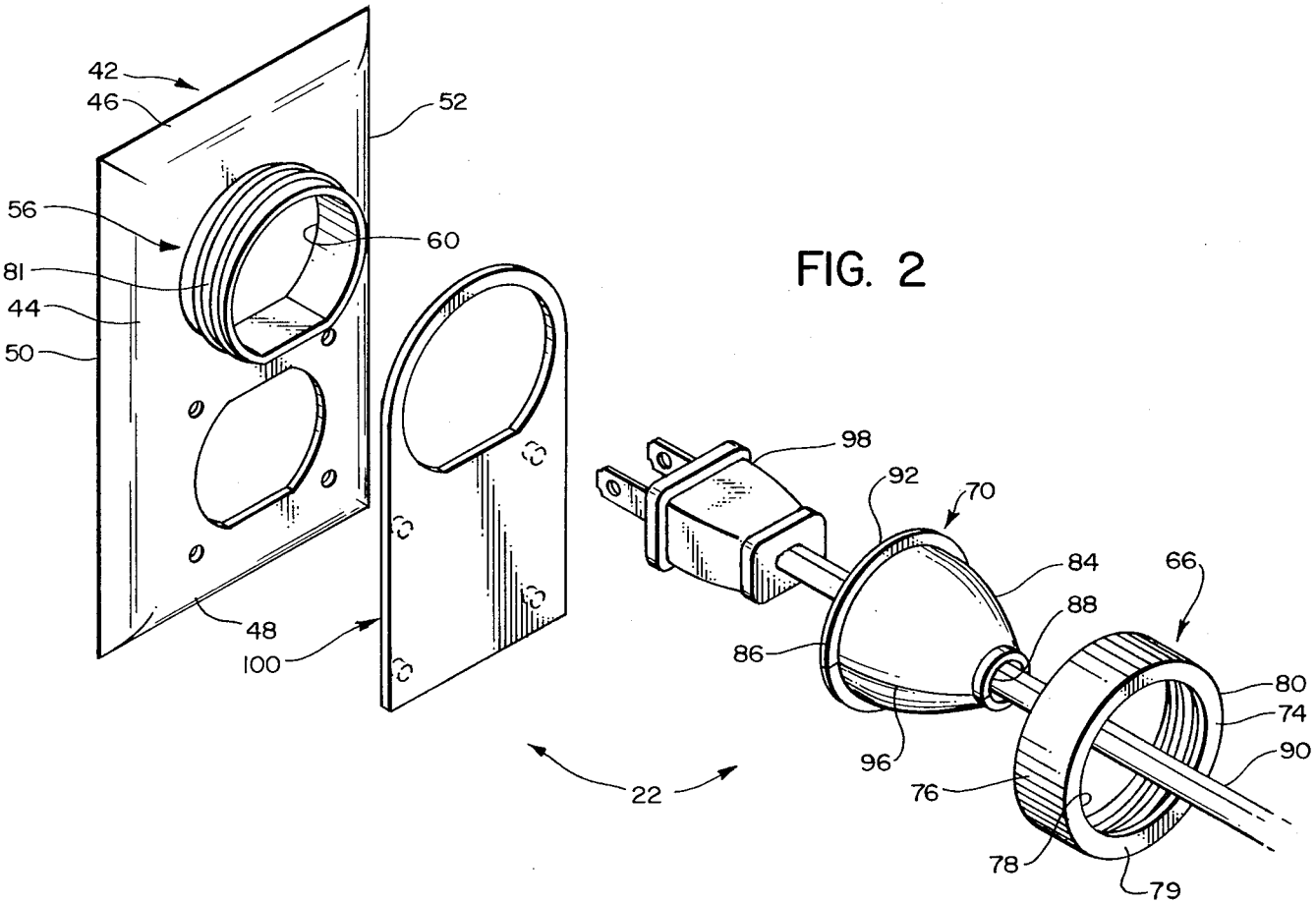
FIG. 2 is an exploded view of the protective cover and a line cord plug to which access is denied by the protective cover when that plug is inserted into the matching female socket of an electrical outlet.

Referring now to the drawing, FIGS. 1 and 2 depict, in detail, an electrical outlet 20 to which access is limited by a protective cover or device 22 constructed in accord with, and embodying, the principles of the present invention.

Outlet 20 is of conventional construction; it includes sockets 23 and 24 supported from a bracket 26. As is required by code, the outlet is housed in an electrical box 28. In the exemplary installation shown in FIG. 1, this box is attached to a vertical stud 30 of a wall which also includes drywall 32 attached to the stud. A cut-out 34 in the drywall accommodates electrical box 28.

Outlet 20 is attached to box 28 by the usual screws 36 and 38 with female sockets or connectors 23 and 24 facing the open side 40 of the box.

Referring now to FIG. 1 and to FIG. 2, protective cover 22 includes a rectangular base plate 42 which has a top wall 44 bounded by angularly included upper, lower, and side walls 46, 48, 50, and 52. To all intents and purposes, plate 42 may be identical to the conventional outlet cover plate except as noted below; and it is attached to bracket 26 of outlet 20 like the latter by the customary screw 54 which extends through an opening (not shown) in the top wall 44 of base plate 42.

Plate 42 differs from a conventional outlet plate in that it includes an integral, externally threaded boss 56 which surrounds an opening 60 through the top wall 44 of the plate and protrudes outwardly from the plate. This opening is so located that it is aligned with socket 23 when plate 42 is attached to outlet 20. This is done by inserting screw 54 through the aperture in top wall 44 and then threading that screw into the socket supporting bracket 26 of outlet 20.

Figure 3:
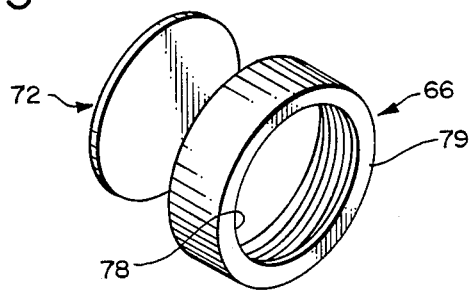
FIG. 3 is an exploded view of a safety cap and a protective disk employed in the device of FIG. 1 to deny access to a wall outlet socket when that socket is not in use.

In addition to plate 42, protective cover 22 includes a safety cap 66, a dome-shaped protective shield 70 and a disk-like protective member or barrier 72 see FIG. 3.

As is best shown in FIG. 2, safety cap 66 has a flat top wall 74 surrounded by a cylindrical, internally threaded side wall 76. An aperture 78 through which a line cord and a male plug attached to the end of that cord can be routed is formed in top wall 74, leaving a surrounding flange or rim 79.

Preferably, and typically, the central opening 78 through safety cap top wall 74 is made large enough in diameter to accommodate outsized plugs such as replacement plugs, those found on older line cords or on heavy duty extension cords, or plugs which are larger than usual because of an associated attachment—for example, a molded in clip which can be employed to secure the free, plug equipped end of the line cord to a different section of that cord when an appliance equipped with the cord is stored.

This central opening and the size of the cap in which it is formed can be as large as is wanted as long as the diameter of the boss 56 on which the safety cap is threaded remains small enough to give access to the opening in plate 42 through which the screw 54 securing the protective device 22 to outlet 20 is installed. This allows the external boss diameter to be quite large as the flattened lower part 79*a* of the boss will still allow access to the screw accepting aperture in base plate 42 in this circumstance. It is immaterial that the safety cap covers this screw as base plate 42 can be attached to outlet bracket 26 before the safety cap is threaded on the boss. Thus, essentially the only limit on the diameter of safety cap 66 is that it not be so large as to interfere with the use of the second female socket 24 of electrical outlet 20.

One of the important features of the present invention is that the internal threads 80 in safety cap 66 and the external threads 81 on boss 56 are so formed that, to engage these threads so that the safety cap may be removed from the boss, the cap must be firmly pressed toward base plate 42 of the protective device and simultaneously rotated in a counterclockwise direction. That is, the safety caps are of the press-and-twist type. As discussed above, past experience has shown that this scheme is essentially childproof which is one of the important goals of the present invention.

The protective disk or barrier 72 is designed to be employed when a socket is not being used. It is dimensioned to fit within safety cap 66 and to be trapped against the boss 56 on which the safety cap is threaded by the annular flange constituted by the top wall 74 of the safety cap. This completely precludes access to the socket 23 of electrical outlet 20, essentially eliminating any possibility of an anatomical member on foreign object coming into contact with the socket. This component of protective cover 22 can be like those described in copending application Ser. No. 815,528.

Instead of a protective disk, the dome-shaped shield 70 mentioned briefly above is employed to preclude access to a socket such as that identified by reference character 24 when the socket is in use. This shield, which is formed of any suitable resilient material, includes a dome 84 and an annular flange 86. An opening 88 through which a line cord 90 can be routed, and which is dimensioned to closely surround the line cord, is formed in the closed end of dome 84. The opposite, open end 92 of the shield is surrounded by the integral, or integrated, annular flange or rim 86 of the shield.

Protective shield 70 is split from end-to-end, providing the gap 96 shown in FIG. 2. This allows the protective shield to be pried apart so that line cord 90 can be installed in it as shown in the same figure.

To use protective cover 22 to preclude access to an electrical socket in use, the line cord 90 and plug 98 attached to the end of that cord are first routed through safety cap 66. Protective shield 70 is then installed over line cord 90 in the manner just described between plug 98 and the safety cap. Next, plug 98 is mated with female socket 23 of outlet 20. Then, protective shield 70 is slid down line cord 90 until flange 86 abuts the boss 56 of the protective cover. Finally, the safety cap is threaded onto the boss to trap the flange 86 of the protective shield between the boss and the rim 79 of the safety cap. Again, the scheme is one which completely precludes access to the female socket in use.

The final component of protective cover 22 is a generally rectangular shield 100 with a rounded top. Shield 100 is provided to deny access to the second female socket or connector 24 of electrical outlet 20. This shield, which is fabricated of any appropriate rigid sheet material, is joinnalled or pivotably supported on protective cover base plate boss 56 which extends through an opening 102 near the upper end of the shield.

When socket 24 is not being used, shield 100 is clamped against base plate 42 by safety cap 66 as shown in FIG. 1, making socket 24 inaccessible. To insure that this objective is reached, inwardly extending pins or lugs 104 are formed on shield 100, and matching recesses 106 are formed in the protective cover base plate 42.

With shield 100 clamped against base plate 42 by safety cap 66 and lugs 104 received in recesses 106, the shield cannot be pried away from base plate 42; and it cannot be swung aside because of the interlock between shield 100 and the base plate provided by the lugs and recesses 106.

The novel arrangement just described has the significant advantage that it affords controlled access to the lower female socket 24 of electrical outlet 20 when such access is wanted. This allows a line cord plug to be mated to that socket. While the line cord plug and socket 24 can be reached in such circumstances, this may be acceptable; e.g., when a responsible adult is present to insure that any infant or other person unaware of the danger posed by the exposed socket and line cord plug does not come into contact with those potentially dangerous components.

To gain access to socket 24, safety cap 66 is backed off to the extent that allows shield 100 to be pulled away from protective cover base plate 42 and lugs 104 to clear the recesses 106 in the base plate. Then, the protective shield can be swung aside on boss 56 to expose socket 24 and allow a male line cord plug to be mated to the socket.

Once the need for socket 24 has expired, protection of that socket can be resumed by swinging shield 100 back into overlying relationship to the socket, engaging lugs 104 in base plate recesses 106, and tightening safety cap 66 to clamp shield 100 against base plate 42.

It was suggested above that the novel protective covers disclosed herein are particularly useful when an oversized plug or one having an attachment associated therewith is to be protected and the room needed for base plate bosses and safety caps able to protect both sockets of a conventional dual socket electrical outlet is lacking. That a plug as just described be involved is not a requisite, however; and protective covers as disclosed herein can be used in any circumstances where one plug of an outlet is to be protected when in use while controllable access to a second, associated socket is to be available.

In the just-concluded, detailed description of our invention, several references to orientations such as top, side, upper, lower, etc., were made. This was done for the sake of brevity and to clearly explain the invention and that approach is not intended to impose any restrictions on the scope of our invention as defined in the appended claims.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What we claim as our invention is:

1. A protective cover for an electrical outlet having first and second exposed female connectors, said cover including: a base plate which is adapted to fit over and be attached to said outlet, there being an aperture through said plate which is then aligned with said one of said female connectors and thereby allows a male connector to be plugged into that female connector; an externally threaded boss protruding outwardly from said base plate and surrounding said aperture; means which is or comprises an internally threaded safety cap adapted to be threaded onto said boss to prevent access to said female connector through said aperture, the external threads on said boss and the internal threads in said safety cap being so related that pressure must be exerted on said safety cap and said cap simultaneously rotated to engage said external and internal threads and allow said cap to be removed from said boss; and a protective shield which is dimensioned to overlie, and thereby deny access to, the second of said female connectors, said shield being journalled on said outwardly protruding boss between said base plate and said internally threaded safety cap and thereby being adapted to be clamped to said base plate by said cap to retain said protective shield in overlying relation to said second female connector.

2. A protective cover as defined in claim 1 which has matable pins and recesses for positively retaining said cover in the position overlying the second of the female connectors when said protective shield is clamped against said plate by said internally threaded safety cap, said recesses being formed in either the protective shield or the base plate of the protective cover and the pins being formed on and projecting from the other of the protective shield and base plate components.

3. A protective cover as defined in claim 1 wherein said safety cap has an opening in it through which a line cord and a male connector attached thereto can be routed and wherein said cap has an annular rim surrounding said aperture, the means for preventing access to the female connector also including a barrier component for blocking access to said female connector through said cap, said barrier device being configured to fit within said cap and to be trapped therein and against said boss by the flange of the cap.

4. A protective outlet cover as defined in claim 1 wherein said safety cap has an opening through which a line cord and a male plug attached thereto can be routed and an annular rim surrounding said opening, said protective outlet cover also including a component for precluding access to said female connector through the aperture in said cap, said component having an open-ended, circularly sectioned dome of resilient, flexible material and an annular rim integrated with said dome at the open end thereof, there being an opening of sufficient size to accommodate only a line cord in that end of the dome opposite said rim, said component being split from end-to-end to form a gap which can be enlarged to allow a line cord to be routed through the device, and said device being so dimensioned that said safety cap can be slipped over said dome and then threaded on said boss to trap the flange on said component between said boss and the flange on the safety cap.

* * * * *